US012215958B2

(12) United States Patent
Groff et al.

(10) Patent No.: US 12,215,958 B2
(45) Date of Patent: Feb. 4, 2025

(54) DETECTING MAGAZINE TYPES USING MAGNETS

(71) Applicant: Axon Enterprise, Inc., Scottsdale, AZ (US)

(72) Inventors: John Groff, San Francisco, CA (US); Trevor Ryan, Tahoe City, CA (US); Michael Roberts, San Francisco, CA (US); Magne H Nerheim, Paradise Valley, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 206 days.

(21) Appl. No.: 17/834,549

(22) Filed: Jun. 7, 2022

(65) Prior Publication Data

US 2023/0146388 A1 May 11, 2023

Related U.S. Application Data

(60) Provisional application No. 63/197,603, filed on Jun. 7, 2021.

(51) Int. Cl.
*F41H 13/00* (2006.01)
*F41A 17/38* (2006.01)

(52) U.S. Cl.
CPC ..... *F41H 13/0012* (2013.01); *F41A 17/38* (2013.01)

(58) Field of Classification Search
CPC ..... F41H 13/0012; F41A 17/38
See application file for complete search history.

(56) References Cited

U.S. PATENT DOCUMENTS 6,402,284 B1 * 6/2002 Merz ..... B41J 2/17503 347/50
2012/0257320 A1 10/2012 Brundula et al.
2018/0142994 A1 5/2018 Otte et al.
2019/0390932 A1 12/2019 Schulz et al.
2020/0355450 A1 11/2020 Masarik et al.

FOREIGN PATENT DOCUMENTS

CN 205425968 U 8/2016
TW 200724850 A 7/2007
TW 200726954 A 7/2007
WO 2008097242 A2 8/2008
WO 2017031426 A1 2/2017

OTHER PUBLICATIONS

Taiwan Intellectual Property Office, Search Report and Office Action for Taiwanese Application No. 111121035 mailed Jun. 5, 2023.
Korean Intellectual Property Office, International Search Report for International Application No. PCT/US22/32537 mailed Sep. 19, 2022.
Taiwan Patent Office, Allowance Decision of Examination for Taiwan Application No. 111121035 mailed Dec. 5, 2023.

* cited by examiner

*Primary Examiner* — Scott Bauer
(74) *Attorney, Agent, or Firm* — H S. Malvich, Jr.; Andrew Graham

(57) ABSTRACT

Magazines of conducted electrical weapons (CEW) comprise a set of magnetic elements having positions, polarities, and magnitudes corresponding to a type of magazine. The CEW uses sensors to detect an indicator magnet indicating that a magazine is inserted into a bay of the CEW. The CEW additionally uses sensors to detect information about the set of magnetic elements and determines, based on the detected information, a type of the magazine.

20 Claims, 6 Drawing Sheets

DETECTING MAGAZINE TYPES USING MAGNETS

FIELD OF THE INVENTION

Embodiments of the present invention relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
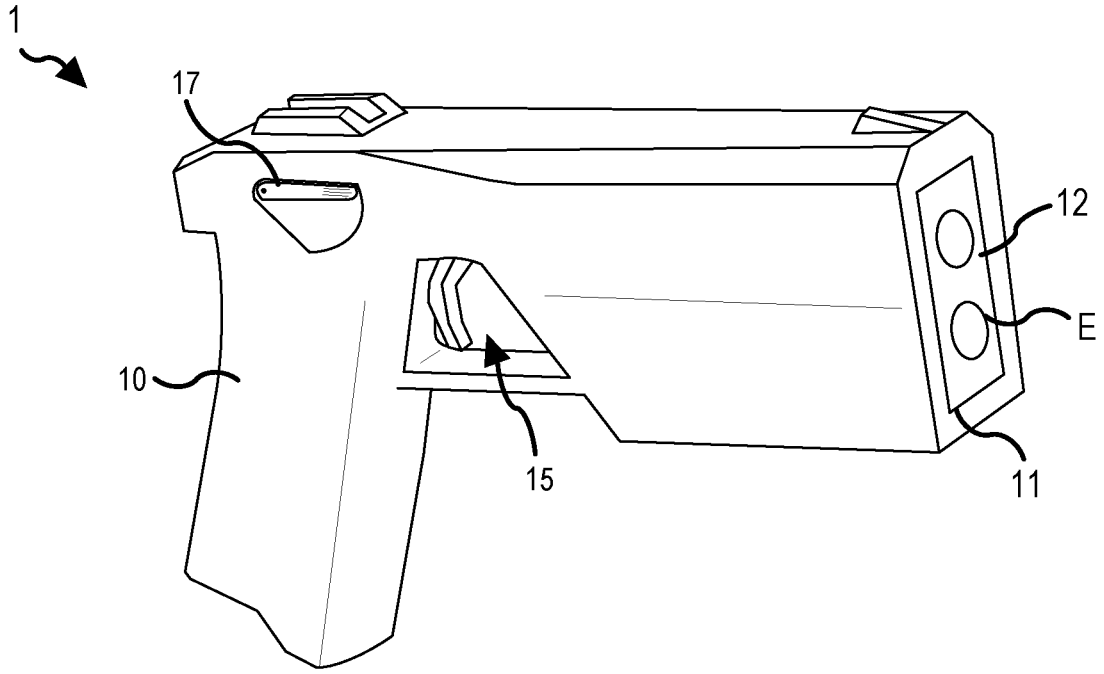
FIG. 1 is a perspective view of a conducted electrical weapon ("CEW"), in accordance with various embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a magazine (e.g., deployment unit). The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines (e.g., deployment units, etc.). The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may include two or more electrodes (e.g., projectiles, cartridges, etc.) that are launched at the same time. In various embodiments, a magazine may include two or more electrodes that may each be launched individually at separate times. In various embodiments, a magazine may include a single electrode configured to be launched from the magazine. Launching the electrodes may be referred to as activating (e.g., firing) a magazine or electrode. After use (e.g., activation, firing), a magazine may be removed from the bay and replaced with an unused (e.g., not fired, not activated) magazine to permit launch of additional electrodes.

Figure 2:
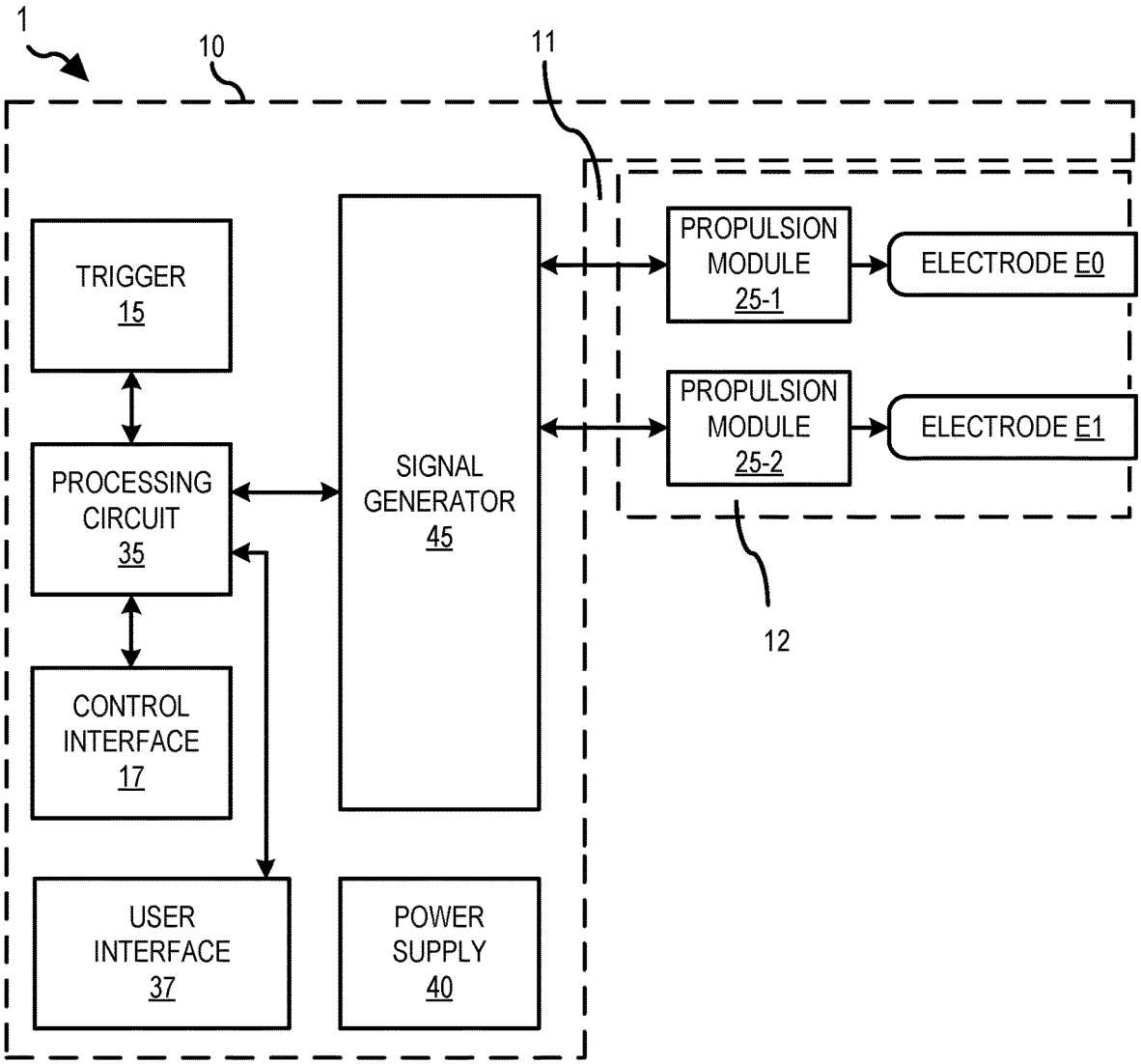
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a housing 10 and a magazine 12. It should be understood by one skilled in the art that FIG. 2 is a schematic representation of CEW 1, and one or more of the components of CEW 1 may be located in any suitable position within, or external to, housing 10.

Housing 10 may be configured to house various components of CEW 1 that are configured to enable deployment of magazine 12, provide an electrical current to magazine 12, and otherwise aid in the operation of CEW 1, as discussed further herein. Although depicted as a firearm in FIG. 1, housing 10 may comprise any suitable shape and/or size. Housing 10 may comprise a handle end opposite a deployment end. A deployment end may be configured, and sized and shaped, to receive one or more magazine 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, housing 10 may comprise various mechanical, electronic, and/or electrical components configured to aid in performing the functions of CEW 1. For example, housing 10 may comprise one or more triggers 15, control interfaces 17, processing circuits 35, power supplies 40, and/or signal generators 45. Housing 10 may include a guard (e.g., trigger guard). A guard may define an opening formed in housing 10. A guard may be located on a center region of housing 10 (e.g., as depicted in FIG. 1), and/or in any other suitable location on housing 10. Trigger 15 may be disposed within a guard. A guard may be configured to protect trigger 15 from unintentional physical contact (e.g., an unintentional activation of trigger 15). A guard may surround trigger 15 within housing 10.

In various embodiments, trigger 15 be coupled to an outer surface of housing 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more magazine 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more magazine 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via magazine 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuitry. Signal conditioning circuitry may include level shifters to change (e.g., increase, decrease) the magnitude of a voltage (e.g., of a signal) before receipt by processing circuit 35 or to shift the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible non-transitory computer-readable memory. Instructions stored on the tangible non-transitory memory may allow processing circuit 35 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1. Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 17. Processing circuit 35 may be configured to detect an activation, actuation, depression, input, etc. (collectively, a "control event") of control interface 17. In response to detecting the control event, processing circuit 35 may be configured to perform various operations and/or functions, as discussed further herein. Processing circuit 35 may also include a sensor (e.g., a control sensor) attached to control interface 17 and configured to detect a control event of control interface 17. The sensor may comprise any suitable mechanical and/or electronic sensor capable of detecting a control event in control interface 17 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 17, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, signal generator 45 may be configured to receive one or more control signals from processing circuit 35. Signal generator 45 may provide an ignition signal to magazine 12 based on the control signals. Signal generator 45 may be electrically and/or electronically coupled to processing circuit 35 and/or magazine 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within housing 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to magazine 12 (or an electrode in magazine 12). For example, signal generator 45 may provide an electrical signal as an ignition signal to magazine 12 in response to receiving a control signal from processing circuit 35. In various embodiments, the ignition signal may be separate and distinct from a stimulus signal. For example, a stimulus signal in CEW 1 may be provided to a different circuit within magazine 12, relative to a circuit to which an ignition signal is provided. Signal generator 45 may be configured to generate a stimulus signal. In various embodiments, a second, separate signal generator, component, or circuit (not shown) within housing 10 may be configured to generate the stimulus signal. Signal generator 45 may also provide a ground signal path for magazine 12, thereby completing a circuit for an electrical signal provided to magazine 12 by signal generator 45. The ground signal path may also be provided to magazine 12 by other elements in housing 10, including power supply 40.

In various embodiments, a bay 11 of housing 10 may be configured (to receive one or more magazine 12. Bay 11 may comprise an opening in an end of housing 10 sized and shaped to receive one or more magazine 12. Bay 11 may include one or more mechanical features configured to removably couple one or more magazine 12 within bay 11. Bay 11 of housing 10 may be configured to receive a single magazine, two magazines, three magazines, nine magazines, or any other number of magazines.

Magazine 12 may comprise one or more propulsion modules 25 and one or more electrodes E. For example, a magazine 12 may comprise a single propulsion module 25 configured to deploy a single electrode E. As a further example, a magazine 12 may comprise a single propulsion module 25 configured to deploy a plurality of electrodes E. As a further example, a magazine 12 may comprise a plurality of propulsion modules 25 and a plurality of electrodes E, with each propulsion module 25 configured to deploy one or more electrodes E. In various embodiments, and as depicted in FIG. 2, magazine 12 may comprise a first propulsion module 25-1 configured to deploy a first electrode E0 and a second propulsion module 25-2 configured to deploy a second electrode E1. Each series of propulsion modules and electrodes may be contained in the same and/or separate magazines.

In various embodiments, a propulsion module 25 may be coupled to, or in communication with one or more electrodes E in magazine 12. In various embodiments, magazine 12 may comprise a plurality of propulsion modules 25, with each propulsion module 25 coupled to, or in communication with, one or more electrodes E. A propulsion module 25 may comprise any device, propellant (e.g., air, gas, etc.), primer, or the like capable of providing a propulsion force in magazine 12. The propulsion force may include an increase in pressure caused by rapidly expanding gas within an area or chamber. The propulsion force may be applied to one or more electrodes E in magazine 12 to cause the deployment of the one or more electrodes E. A propulsion module 25 may provide the propulsion force in response to magazine 12 receiving an ignition signal, as previously discussed.

In various embodiments, the propulsion force may be directly applied to one or more electrodes E. For example, a propulsion force from propulsion module 25-1 may be provided directly to first electrode E0. A propulsion module 25 may be in fluid communication with one or more electrodes E to provide the propulsion force. For example, a propulsion force from propulsion module 25-1 may travel within a housing or channel of magazine 12 to first electrode E0. The propulsion force may travel via a manifold in magazine 12.

In various embodiments, the propulsion force may be provided indirectly to one or more electrodes E. For example, the propulsion force may be provided to a secondary source of propellant within propulsion system 125. The propulsion force may launch the secondary source of propellant within propulsion system 125, causing the secondary source of propellant to release propellant. A force associated with the released propellant may in turn provide a force to one or more electrodes E. A force generated by a secondary source of propellant may cause the one or more electrodes E to be deployed from the magazine 12 and CEW 1.

In various embodiments, each electrode E0, E1 may each comprise any suitable type of projectile. For example, one or more electrodes E may be or include a projectile, an electrode (e.g., an electrode dart), an entablement projectile, a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

Control interface 17 of CEW 1 may comprise, or be similar to, any control interface disclosed herein. In various embodiments, control interface 17 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of magazine 12, and/or similar operations, as discussed further herein. In various embodiments, control interface 17 may also be configured to perform (or cause performance of) one or more operations that do not include the selection of firing modes. For example, control interface 17 may be configured to enable the selection of operating modes of CEW 1, selection of options within an operating mode of CEW 1, or similar selection or scrolling operations, as discussed further herein.

Control interface 17 may be located in any suitable location on or in housing 10. For example, control interface 17 may be coupled to an outer surface of housing 10. Control interface 17 may be coupled to an outer surface of housing 10 proximate trigger 15 and/or a guard of housing 10. Control interface 17 may be electrically, mechanically, and/or electronically coupled to processing circuit 35. In various embodiments, in response to control interface 17 comprising electronic properties or components, control interface 17 may be electrically coupled to power supply 40. Control interface 17 may receive power (e.g., electrical current) from power supply 40 to power the electronic properties or components.

Control interface 17 may be electronically or mechanically coupled to trigger 15. For example, and as discussed further herein, control interface 17 may function as a safety mechanism. In response to control interface 17 being set to a "safety mode," CEW 1 may be unable to launch electrodes from magazine 12. For example, control interface 17 may provide a signal (e.g., a control signal) to processing circuit 35 instructing processing circuit 35 to disable deployment of electrodes from magazine 12. As a further example, control interface 17 may electronically or mechanically prohibit trigger 15 from activating (e.g., prevent or disable a user from depressing trigger 15; prevent trigger 15 from launching an electrode; etc.).

Control interface 17 may comprise any suitable electronic or mechanical component capable of enabling selection of firing modes. For example, control interface 17 may comprise a fire mode selector switch, a safety switch, a safety catch, a rotating switch, a selection switch, a selective firing mechanism, and/or any other suitable mechanical control. As a further example, control interface 17 may comprise a slide, such as a handgun slide, a reciprocating slide, or the like. As a further example, control interface 17 may comprise a touch screen, user interface or display, or similar electronic visual component.

The safety mode may be configured to prohibit deployment of an electrode from magazine 12 in CEW 1. For example, in response to a user selecting the safety mode, control interface 17 may transmit a safety mode instruction to processing circuit 35. In response to receiving the safety mode instruction, processing circuit 35 may prohibit deployment of an electrode from magazine 12. Processing circuit 35 may prohibit deployment until a further instruction is received from control interface 17 (e.g., a firing mode instruction). As previously discussed, control interface 17 may also, or alternatively, interact with trigger 15 to prevent activation of trigger 15. In various embodiments, the safety mode may also be configured to prohibit deployment of a stimulus signal from signal generator 45, such as, for example, a local delivery.

The firing mode may be configured to enable deployment of one or more electrodes from magazine 12 in CEW 1. For example, and in accordance with various embodiments, in response to a user selecting the firing mode, control interface 17 may transmit a firing mode instruction to processing circuit 35. In response to receiving the firing mode instruction, processing circuit 35 may enable deployment of an electrode from magazine 12. In that regard, in response to trigger 15 being activated, processing circuit 35 may cause the deployment of one or more electrodes. Processing circuit 35 may enable deployment until a further instruction is received from control interface 17 (e.g., a safety mode instruction). As a further example, and in accordance with various embodiments, in response to a user selecting the firing mode, control interface 17 may also mechanically (or electronically) interact with trigger 15 of CEW 1 to enable activation of trigger 15.

In various embodiments, CEW 1 may deliver a stimulus signal via a circuit that includes signal generator 45 positioned in the handle of CEW 1. An interface (e.g., cartridge interface, magazine interface, etc.) on each magazine 12 inserted into housing 10 electrically couples to an interface (e.g., handle interface, housing interface, etc.) in handle housing 10. Signal generator 45 couples to each magazine 12, and thus to the electrodes E, via the handle interface and the magazine interface. A first filament couples to the interface of the magazine 12 and to a first electrode. A second filament couples to the interface of the magazine 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in housing 10. For example, user interface 37 may be coupled to an outer surface of housing 10, or extend at least partially through the outer surface of housing 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3A:
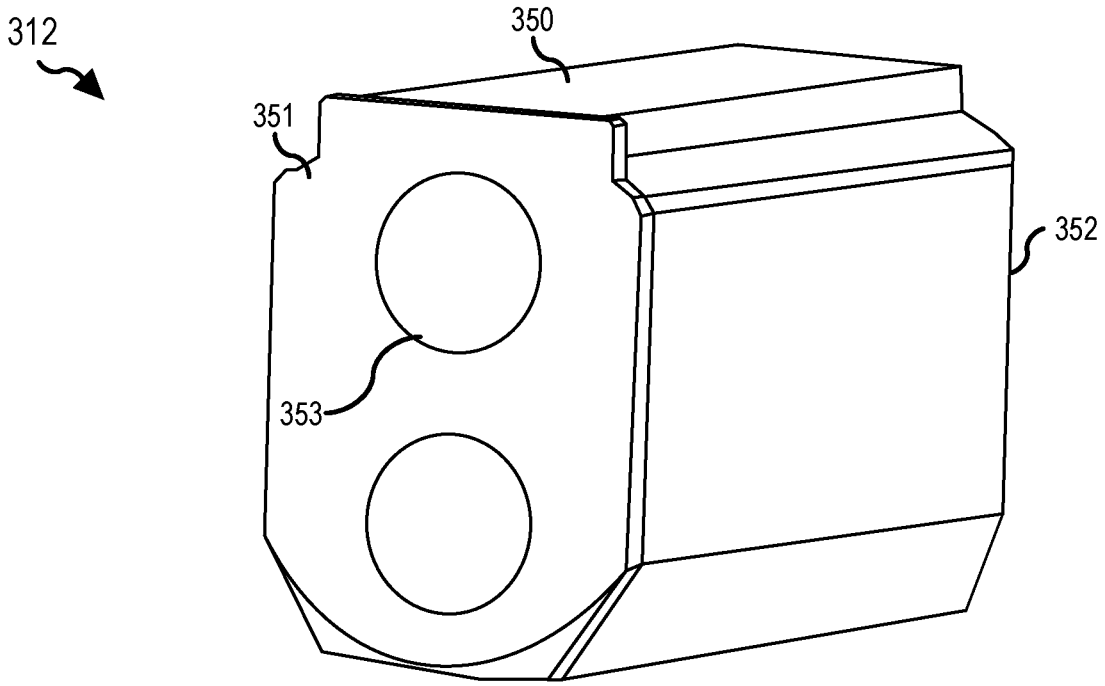
FIG. 3A is a front perspective view of a magazine for a CEW, in accordance with various embodiments.
Figure 3B:
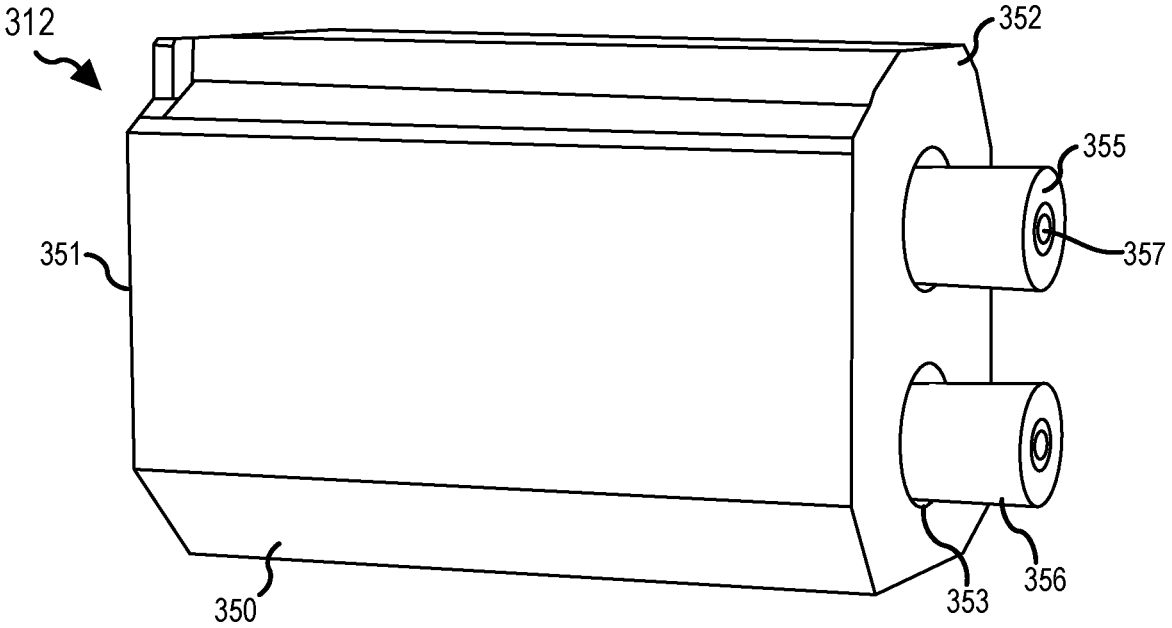
FIG. 3B is a rear perspective view of a magazine for a CEW, in accordance with various embodiments.

In various embodiments, and with reference to FIGS. 3A and 3B, a magazine 312 for a CEW is disclosed. Magazine 312 may be similar to any other magazine, deployment unit, or the like disclosed herein.

Magazine 312 may comprise a housing 350 sized and shaped to be inserted into the bay 11 of a CEW handle, as previously discussed. Housing 350 may comprise a first end 351 (e.g., a deployment end, a front end, etc.) opposite a second end 352 (e.g., a loading end, a rear end, etc.). Magazine 312 may be configured to permit launch of one or more electrodes from first end 351 (e.g., electrodes are launched through first end 351). Magazine 312 may be configured to permit loading of one or more electrodes from second end 351. Second end 351 may also be configured to permit provision of stimulus signals from the CEW to the one or more electrodes. In some embodiments, magazine 312 may also be configured to permit loading of one or more electrodes from first end 351.

In various embodiments, housing 350 may define one or more bores 353. A bore 353 may comprise an axial opening through housing 350, defined and open on first end 351 and/or second end 352. Each bore 353 may be configured to receive an electrode (or cartridge containing an electrode). Each bore 353 may be sized and shaped accordingly to receive and house an electrode (or cartridge containing an electrode) prior to and during deployment of the electrode from magazine 312. Each bore 353 may comprise any suitable deployment angle. One or more bores 353 may comprise similar deployment angles. One or more bores 353 may comprise different deployment angles. Housing 350 may comprise any suitable or desired number of bores 353, such as, for example, two bores, five bores, nine bores, ten bores, and/or the like.

In various embodiments, magazine 350 may be configured to receive one or more cartridges 355. A cartridge 355 may comprise a body 356 housing an electrode and one or more components necessary to deploy the electrode from body 356. For example, cartridge 355 may comprise an electrode and a propulsion module. The electrode may be similar to any other electrode, projectile, or the like disclosed herein. The propulsion module may be similar to any other propulsion module, primer, or the like disclosed herein.

In various embodiments, cartridge 355 may comprise a cylindrical outer body 356 defining a hollow inner portion. The hollow inner portion may house an electrode (e.g., an electrode, a spear, filament wire, etc.). The hollow inner portion may house a propulsion module configured to deploy the electrode from a first end of the cylindrical outer body 356. Cartridge 355 may include a piston positioned adjacent a second end of the electrode. Cartridge 355 may have the propulsion module positioned such that the piston is located between the electrode and the propulsion module. Cartridge 355 may also have a wad positioned adjacent the piston, where the wad is located between the propulsion module and the piston.

In various embodiments, a cartridge 355 may comprise a contact 357 on an end of body 356. Contact 357 may be configured to allow cartridge 355 to receive an electrical signal from a CEW handle. For example, contact 357 may comprise an electrical contact configured to enable the completion of an electrical circuit between cartridge 355 and a signal generator of the CEW handle. In that regard, contact 357 may be configured to transmit (or provide) a stimulus signal from the CEW handle to the electrode. As a further example, contact 357 may be configured to transmit (or provide) an electrical signal (e.g., an ignition signal) from the CEW handle to a propulsion module within the cartridge 355. For example, contact 357 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 355.

In operation, a cartridge 355 may be inserted into a bore 353 of a magazine 312. The magazine 312 may be inserted into the bay 11 of a CEW handle. The CEW may be operated to deploy an electrode from the cartridge 355 in magazine 312. Magazine 312 may be removed from the bay 11 of the CEW handle. The cartridge 355 (e.g., a used cartridge, a spent cartridge, etc.) may be removed from the bore 353 of magazine 312. A new cartridge 355 may then be inserted into the same bore 353 of magazine 312 for additional deployments. The number of cartridges 355 that magazine 350 is capable of receiving may be dependent on a number of bores 353 in housing 350. For example, in response to housing 350 comprising four bores 353, magazine 350 may be configured to receive at most four cartridges 355 at the same time. As a further example, in response to housing 350 comprising two bores 353, magazine 350 may be configured to receive at most two cartridges 355 at the same time.

Magnetic Magazine Type Detection

Magazines of conducted electrical weapons (CEW) comprise a set of magnetic elements having positions, polarities, and magnitudes corresponding to a type of magazine. The CEW uses sensors to detect an indicator magnet indicating that a magazine is inserted into a bay 11 of the CEW. The CEW additionally uses sensors to detect information about the set of magnetic elements and determines, based on the detected information, a type of the magazine. Types of magazines can determine a number of factors relevant to operation of the CEW in conjunction with a given magazine, such as a number of cartridges acceptable in the magazine, a type of cartridges acceptable within a magazine, capabilities of a magazine, and/or the like.

Figure 4:
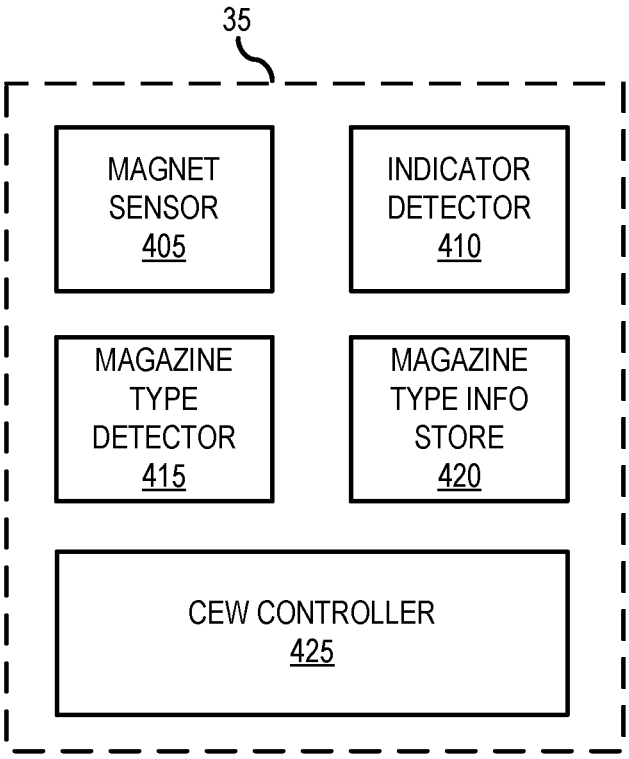
FIG. 4 is a block diagram illustrating an example processing unit for a CEW, in accordance with various embodiments.

FIG. 4 is a block diagram illustrating an example processing circuit 35 for a CEW, in accordance with various embodiments. In the embodiment of FIG. 4, the example processing circuit 35 comprises a magnet sensor 405, an indicator detector 410, a magazine type detector 415, a magazine type info store 420, and a CEW controller 425. In other embodiments, the processing circuit may comprise additional, fewer, or different modules, and modules may perform differently than described herein.

The magnet sensor 405 comprises one or more sensors configured to detect magnetic elements in magazines received in a bay 11 of the CEW 1. In some embodiments, the one or more sensors detect one or more physical properties of the magazine. For example, in some embodiments, the one or more sensors are hall effect sensors. In other embodiments, the one or more sensors may be magneto-resistive, magneto-diode, magneto-transistor, or other types of magnetometers configured to detect magnetic elements in cartridges received in a bay 11 of the CEW 1. In other embodiments, the one or more sensors may additionally or instead detect other physical properties of the magazine 12, such as, for example, one or more of: Indicia printed on the magazines, physical indents, extrusions, other markings on the magazines, or the like.

In some embodiments, the magnet sensor 405 is configured to, responsive to detecting one or more magnetic fields or other physical properties, capture and transmit information about the one or more detected magnetic fields or other physical properties to the indicator detector 410. Information about the one or more detected magnetic fields may comprise, for example, a position of a magnetic element causing the detected magnetic field; a polarity of the magnetic field; a magnitude of the magnetic field; and the like.

The indicator detector 410 receives information about one or more detected magnetic fields from the magnet sensor 405 and determines whether a detected magnetic field of the one or more detected magnetic fields corresponds to an indicator magnet. An indicator magnet (e.g., a first magnet) is a magnetic element in a magazine 12 that indicates to a processing circuit of a CEW 1 that the cartridge has been inserted to the bay 11 of the CEW. In some embodiments, the indicator magnet may have a fixed polarity. In some embodiments, the indicator magnet may have a fixed position on the magazine 12. In some embodiments, the indicator magnet may have a fixed magnitude. In other embodiments, the indicator magnet may have one of a set of fixed positions, magnitudes, and/or polarities, e.g., such that a magnetic field detected within a set of positions, magnitudes, and/or polarities indicate to the processing unit of the CEW 1 that the magazine 12 has been received by the CEW.

In some embodiments, the magazine type detector 415 performs a check for one or more additional magnetic elements (e.g., a second magnet, a third magnet, a fourth magnet, etc.) responsive to the indicator detector 410 detecting an indicator magnet and determines, based on one or more additional magnetic elements, a magazine type of a magazine 12 received by the CEW 1. In other embodiments wherein the magazine does not comprise an indicator magnet, the magazine type detector 415 performs a check for one or more magnetic elements responsive to the indicator detector 410 detecting a magnetic element of the one or more magnetic elements, e.g., a magnetic element that is not an indicator element. In other embodiments wherein the magazine does not comprise an indicator magnet, the magazine type detector 415 performs a check for one or more magnetic elements responsive to other stimuli, e.g., a magazine being inserted into a bay of the CEW 1, an action by a user of the CEW, an instruction received by a remote entity to perform the check, and the like.

In some embodiments, the magazine type detector 415 receives information describing one or more detected magnetic fields and accesses the magazine type info store 420 to determine a magazine type corresponding to the received information describing the one or more detected magnetic fields. The information describing the one or more magnetic fields may comprise a set of respective positions, polarities, and/or magnitudes corresponding to a set of magnetic elements. In some embodiments, e.g., in embodiments wherein the indicator magnet has a fixed position, polarity, and magnitude, the information describing the one or more magnetic fields may exclude information describing an indicator magnet. In other embodiments, the received information may comprise other information about physical properties of the received magazine 12, such as information describing indicia printed on the surface of the magazine, indents, extrusions, other markings on the surface of the magazine, and the like.

The magazine type info store 420 stores and maintains information describing magazine types and magnetic elements or other physical properties corresponding to the magazine types. For example, in some embodiments, magazines comprise three magnetic elements. The three magnetic elements may comprise one indicator magnet and two additional magnetic elements, or may comprise three magnetic elements without an indicator magnet. In other embodiments, magazines comprise fewer or more magnetic elements. Each magazine of a magazine type comprises a fixed set of positions, polarities, and/or magnitudes for each of the magnetic elements. The magazine type info store 420 maintains information describing each fixed set of positions, polarities, and/or magnitudes for known magazine types. As such, based on the information describing the one or more detected magnetic fields and information stored by the magazine type info store 420, the magazine type detector 415 identifies a magazine type having magnetic elements corresponding to the information.

In some embodiments, the magazine type info store 420 additionally stores and maintains information describing one or more additional properties of magazine types. For example, the cartridge type info store 420 may identify a magazine type as comprising (or capable of accepting) a plurality of electrodes E. In another example, the magazine type info store 420 may store information describing a required method of propulsion for the magazine type, a required activation event, a particular type of cartridge, or the like. As a further example, the magazine type info store 420 may store information indicating a type of cartridges acceptable by the magazine, such as a standard cartridge, a virtual reality cartridge, and/or the like.

The CEW controller 425 performs one or more actions responsive to a determination of a magazine type of a magazine 12 received by a CEW 1. In some embodiments, the CEW controller 425 may modify one or more settings or parameters of the CEW 1, such as modifying a number of consecutive deployments of cartridges by the CEW prior to requiring a new cartridge or a new magazine, modifying a required activation event, modifying a control signal, modifying a propulsion event, and/or the like. In other embodiments, the CEW controller 425 may modify a display or control interface of the CEW 1, e.g., by displaying an identifier of the magazine type and/or a remaining number of cartridges and/or electrodes E in the magazine on a display of the CEW, a display of a client device communicatively coupled to the CEW, or the like. In other embodiments, the CEW controller 425 may modify an aiming apparatus of the CEW based on electrode deployment trajectories associated with one or more bores of the magazine type. For example, modifying the aiming apparatus may comprise adjusting one or more aiming lasers to accurately align with the electrode deployment trajectories associated with one or more bores of the magazine type. In other embodiments, the CEW controller 425 may modify (e.g., enable or disable) one or more accessory components of the CEW, such as, for example, a flashlight, an aiming laser, an audio output component, and/or the like.

Figure 5:
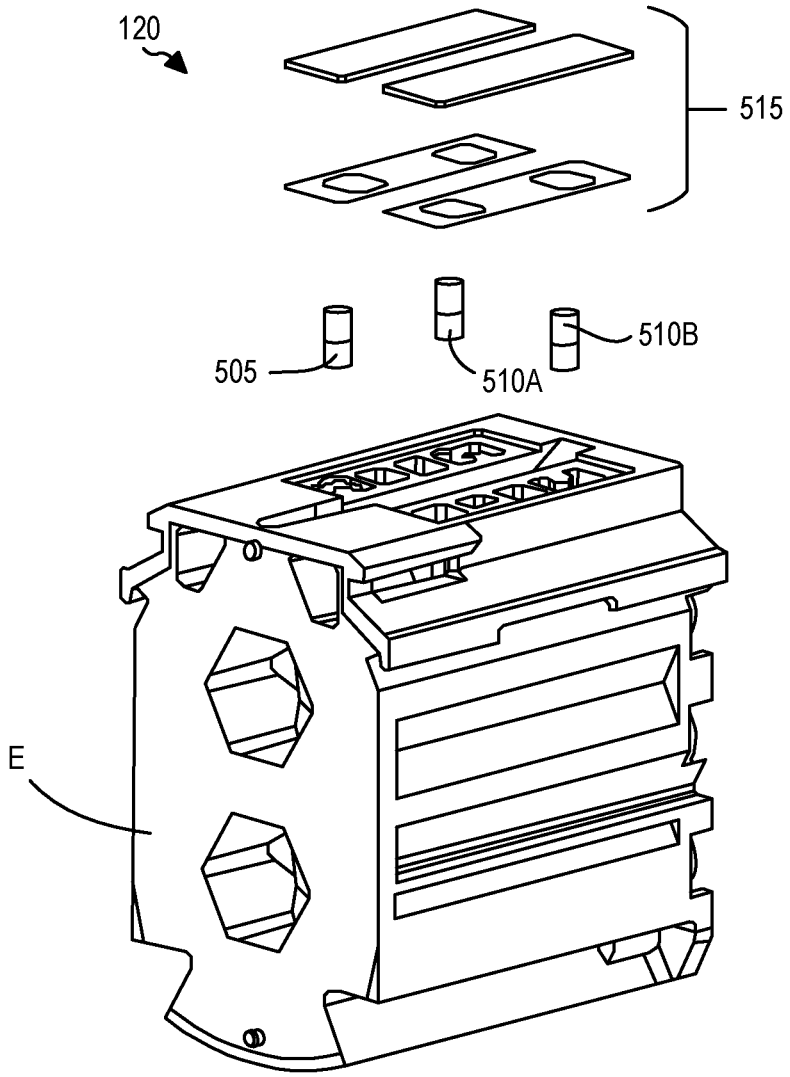
FIG. 5 is a perspective view of a magazine having magnets for type detection, in accordance with various embodiments.

FIG. 5 is a perspective view of a magazine having magnetic elements for type detection, in accordance with various embodiments. As discussed in conjunction with FIGS. 1-2, magazines 12 may comprise one or more electrodes E and are configured to be inserted into a bay 11 of a CEW 1. For example, a magazine 12 may comprise a single electrode E or may comprise a plurality of electrodes. Magazines 12 are associated with a magazine type, which identifies parameters associated with the magazine. For example, a magazine type may identify a number of electrodes E associated with the magazine 12 or with a cartridge of the magazine. In another example, a magazine type may identify other parameters associated with the magazine 12 as discussed in FIGS. 1-2, e.g., activation events, control signals, propulsion events or methods, and the like.

The magazine 12 comprises a set of magnetic elements 505, 510. In some embodiments, a first magnetic element is an indicator magnet 505. As discussed previously, the indicator magnet 405 is a magnetic element in a magazine 12 that indicates to a processing unit of a CEW 1 that the cartridge has been inserted to the bay 11 of the CEW. In some embodiments, the indicator magnet 405 may have fixed properties across one or more cartridge types, such as a fixed position on the cartridge, a fixed polarity, and/or a fixed magnitude, so as to be readily identifiable by the CEW 1. In other embodiments, the indicator magnet 505 may vary in position, polarity, and/or magnitude across one or more cartridge types.

One or more additional magnetic elements 510 (e.g., magnetic element 510A, magnetic element 510B, etc.) may have differing positions, polarities, and magnitudes across one or more cartridge types, such that each cartridge type corresponds to a unique set of properties of additional magnetic elements. For example, a first cartridge type may have an indicator magnet 505 having a fixed position, polarity, and magnitude, and additional magnetic elements 510A-B having a set of properties A and B, while a second cartridge type may have an indicator magnet 405 having the same fixed position, polarity, and magnitude, and additional magnetic elements 510 having sets of properties B and C. As shown in the embodiment of FIG. 5, the magazine 12 comprises one indicator magnet 505 and two additional magnetic elements 510A-B for a total of three magnetic elements. In other embodiments, the magazine 12 may comprise additional magnetic elements, fewer magnetic elements, and magnetic elements in positions different than illustrated in FIG. 5.

In some embodiments, the indicator magnet 505 and the one or more additional magnetic elements 510 are held within the magazine 12 by one or more mechanical components 515. In other embodiments, the indicator magnet 505 and the one or more additional magnetic elements 510 may instead or additionally be held within the magazine 12 using mechanical components not shown here, such as via clamping or other locking mechanisms within the magazine body. In other embodiments, the indicator magnet 505 and the one or more additional magnetic elements 510 may instead or additionally be held within the magazine 12 using other means, such as being magnetically fixed within the magazine, fixed using an adhesive, and/or the like.

In various embodiments, the indicator magnet 505 and/or the one or more additional magnetic elements 510 may be located in any suitable position within or on a magazine. For example, the indicator magnet 505 and/or the one or more additional magnetic elements 510 may be located in a position capable of enabling the indicator magnet 505 and/or the one or more additional magnetic elements 510 to interface with components of the CEW handle capable of determining the physical properties of the indicator magnet 505 and/or the one or more additional magnetic elements 510. For example, although depicted in FIG. 5 as being disposed proximate a top of a magazine, it should be understand that the indicator magnet 505 and/or the one or more additional magnetic elements 510 may also be disposed proximate a bottom of a magazine, a side of a magazine, a rear end of a magazine, and/or any other suitable position. Further, although depicted in FIG. 5 as the indicator magnet 505 and/or the one or more additional magnetic elements 510 each being disposed together, it should be understood that one or more of the indicator magnet 505 and/or the one or more additional magnetic elements 510 may also be positioned separately. For example, the indicator magnet 505 may be disposed in a first location on the magazine and the one or more additional magnetic elements 510 may be disposed in a second location on (or within) the magazine different from the first location. Similarly, and as a further example, one or more of the additional magnetic elements 510 may be disposed in different locations on (or within) the magazine.

In some embodiments, one or more of the indicator magnet 505 and/or the one or more additional magnetic elements 510 may be coupled to an exterior surface of the magazine. In some embodiments, one or more of the indicator magnet 505 and/or the one or more additional magnetic elements 510 may be disposed within the magazine. In some embodiments, one or more of the indicator magnet 505 and/or the one or more additional magnetic elements 510 may be disposed within the magazine and at least partially protrude (or be exposed) through an exterior surface of the magazine.

Figure 6:
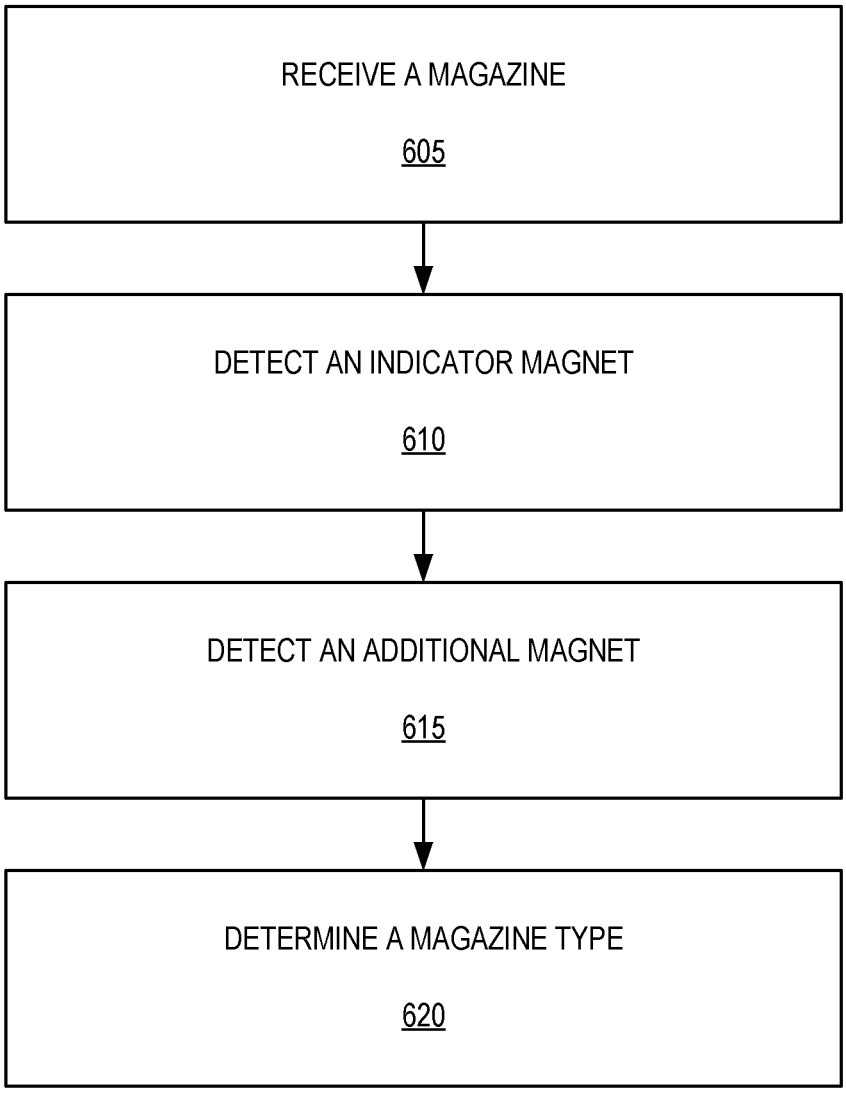
FIG. 6 is a flow chart illustrating a method for detecting magazine types by a CEW, in accordance with various embodiments.

FIG. 6 is a flow chart illustrating a method for detecting magazine types by a CEW, according to some embodiments. For example, and in accordance with various embodiments, the method may include one or more steps for detecting magnetic elements in cartridges and determining cartridge types based on the magnetic elements by a CEW. In other embodiments, the method may include one or more steps for detecting magnetic elements in cartridges to determine when cartridges are inserted to a CEW.

A CEW 1 comprises a bay 11 for receiving one or more magazines 12 and a housing 10 comprising one or more electrical components. The one or more electrical components comprise at least a processing circuit and one or more sensors for detecting magnetic elements 505, 510 and/or other physical properties of magazines within the CEW 1. The CEW 1 receives 605 a magazine 12 into the bay 11 of the CEW. In some embodiments, the bay 11 of the CEW 1 and/or the magazine 12 may comprise mechanical components for receiving the cartridge, aligning the cartridge, and/or locking the cartridge into place.

The CEW 1 may perform a check for one or more magnetic elements. The one or more magnetic elements may each have a physical property. The physical property may comprise a respective position on the magazine, a respective polarity, and/or the like. The check may be performed by the CEW by detecting the one or more magnets, detecting each physical property of the one or more magnets, and/or the like, in accordance with various embodiments.

For example, the CEW 1 detects 610 an indicator magnet 505 (e.g., a first magnet) of the magazine 12. The indicator magnet 505 is a first magnet in the magazine 12 having a first position and a first polarity. In some embodiments, the indicator magnet 505 has a standard position and polarity across one or more magazine types.

For example, the CEW 1 detects 615 one or more additional magnets 510 (e.g., a second magnet, etc.). The CEW 1 may detect the one or more additional magnets 510 together with detecting the indicator magnet 505. The CEW 1 may detect the one or more additional magnets 510 responsive to detecting the indicator magnet 505. The one or more additional magnets 510 may have one or more respective positions on the cartridge and one or more respective polarities. The one or more respective positions may be a set of standard positions on a cartridge, and the one or more respective polarities may be positive, negative, or neutral, and may vary in magnitude.

The CEW 1 determines 620 a cartridge type of the cartridge. The CEW 1 may determine the cartridge type responsive to detecting the indicator magnet 505, the one or more additional magnets 510, a CEW operation (e.g., a safety switch being disabled or enabled, operation of a user interface, a motion detected by a motion detector, etc.), and/or the like. The CEW 1 may determine the cartridge type based on the detected indicator magnet 505, the detected one or more additional magnets 510, physical properties of the magazine, and/or the like.

In some embodiments, the CEW 1 locally stores information describing a set of additional magnets 510 having respective positions and respective polarities corresponding to one or more cartridge types. The locally stored information may also describe properties of the indicator magnet, physical properties of one or more magazines, and/or the like corresponding to one or more cartridge types. In some embodiments, the locally stored information may be stored in a data store (e.g., memory unit) of the CEW 1. The data store of the CEW may comprise a mapping of information about the one or more magnetic elements and a corresponding magazine type.

In other embodiments, the CEW 1 may establish a communication connection with a remote entity, e.g., a vehicle system, a client device, a body-worn camera, or a cloud or other server, and may access or receive information describing sets of additional magnets 510 having respective positions and respective polarities corresponding to one or more cartridge types. The remote entity may also store information describing properties of the indicator magnet, physical properties of one or more magazines, and/or the like corresponding to one or more cartridge types. In some embodiments, the remote entity may store the information in a data store (e.g., memory unit). The data store of the remote entity may comprise a mapping of information about the one or more magnetic elements and a corresponding magazine type.

Based on the cartridge type of the magazine 12, the CEW 1 may perform one or more actions, such as one or more of: modifying one or more settings of the CEW (e.g., a number of expected consecutive deployments of electrodes E prior to reloading a new cartridge); modifying information on a display or control interface of the CEW (e.g., displaying a cartridge type on a user display); and/or the like.

In embodiments of FIG. 6, the method may be performed by a CEW 1. In other embodiments, the method may be performed in part or in whole by other entities. Further, in other embodiments, the method may comprise additional or fewer steps, and the steps may be performed in a different order than described in conjunction with FIG. 6.

CONCLUSION

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments may also relate to an apparatus or system for performing the operations herein. Such an apparatus or system may be specially constructed for the required purpose, and/or it may comprise a general-purpose device selectively activated or reconfigured by a computer program stored in the apparatus or system. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

Examples of various exemplary embodiments embodying aspects of the invention are presented in the following example set. It will be appreciated that all the examples contained in this disclosure are given by way of explanation, and not of limitation.

What is claimed is:

1. A method comprising:

receiving, by a conducted electrical weapon ("CEW"), a magazine into a bay of the CEW;

detecting, by the CEW, an indicator magnet having a first respective position on the magazine and a first respective polarity;

performing, by the CEW, a check for one or more magnetic elements responsive to the indicator magnet being detected, the one or more magnetic elements having one or more second respective positions on the magazine and one or more second respective polarities; and determining, by the CEW and based at least in part on the one or more magnetic elements, a magazine type of the magazine.

2. The method of claim 1, wherein the one or more magnetic elements comprise three magnetic elements.

3. The method of claim 1, wherein determining the magazine type of the magazine is based at least in part on the one or more second respective polarities of the one or more magnetic elements.

4. The method of claim 1, wherein determining the magazine type of the magazine is based at least in part on the one or more second respective positions of the one or more magnetic elements.

5. The method of claim 1, wherein determining the magazine type of the magazine comprises accessing, by the CEW, a data store of the CEW, the data store of the CEW comprising a mapping of information about the one or more magnetic elements and a corresponding magazine type.

6. The method of claim 1, further comprising displaying, by the CEW, information about the magazine type of the magazine for display to a user of the CEW.

7. The method of claim 1, further comprising modifying, by the CEW, one or more parameters of operation of the CEW based at least in part on the magazine type of the magazine.

8. The method of claim 1, wherein the one or more second respective positions are one or more fixed positions and the one or more second respective polarities are one or more fixed polarities of the one or more magnetic elements.

9. A conducted electrical weapon ("CEW") comprising:

a bay configured to receive a magazine;

a memory configured to store information about one or more magazine types; and a processor communicatively coupled to the memory and configured to perform steps comprising:

detecting an indicator magnet having a first respective position on the magazine and a first respective polarity;

determining, based at least on the indicator magnet, that the magazine is within the bay;

performing a check for one or more magnetic elements responsive to the indicator magnet being detected, the one or more magnetic elements having one or more second respective positions on the magazine and one or more second respective polarities; and determining, based at least in part on the one or more magnetic elements, a magazine type of the magazine.

10. The CEW of claim 9, wherein performing the check for the one or more magnetic elements is performed responsive to detecting the indicator magnet.

11. The CEW of claim 9, wherein determining the magazine type of the magazine is based at least in part on the one or more second respective polarities of the one or more magnetic elements.

12. The CEW of claim 9, wherein determining the magazine type of the magazine is based at least in part on the one or more second respective positions of the one or more magnetic elements.

13. The CEW of claim 9, wherein determining the magazine type of the magazine comprises accessing the memory of the CEW, the memory of the CEW comprising a mapping of information about the one or more magnetic elements and a corresponding magazine type.

14. The CEW of claim 9, wherein the processor is further configured to modify one or more parameters of operation of the CEW based at least in part on the magazine type of the magazine.

15. The CEW of claim 9, further comprising a sensor configured to at least in part perform the check for the one or more magnetic elements.

16. The CEW of claim 15, wherein the sensor comprises a hall effect sensor.

17. The CEW of claim 9, wherein determining the magazine type of the magazine comprises establishing, by the CEW, a communication channel with a remote entity and receiving, from the remote entity, a mapping of information about the one or more magnetic elements and a corresponding magazine type.

18. The CEW of claim 9, wherein the processor is further configured to display information about the magazine type of the magazine for display to a user of the CEW.

19. The CEW of claim 18, wherein the information about the magazine type comprises a number of cartridges the magazine can receive.

20. The CEW of claim 18, wherein the information about the magazine type comprises an identifier of the magazine type.

* * * * *